US012736298B2

(12) United States Patent
Lance

(10) Patent No.: US 12,736,298 B2
(45) Date of Patent: Sep. 15, 2026

(54) BOW HOLDER RETENTION APPARATUS AND ASSOCIATED SYSTEMS AND METHODS

(71) Applicant: Mike L. Lance, Hernando, MS (US)

(72) Inventor: Mike L. Lance, Hernando, MS (US)

( * ) Notice: Subject to any disclaimer, the term of this patent is extended or adjusted under 35 U.S.C. 154(b) by 50 days.

(21) Appl. No.: 18/761,106

(22) Filed: Jul. 1, 2024

(65) Prior Publication Data

US 2025/0075997 A1 Mar. 6, 2025

Related U.S. Application Data

(60) Provisional application No. 63/535,734, filed on Aug. 31, 2023.

(51) Int. Cl.
*F41B 5/14* (2006.01)
*F41B 5/10* (2006.01)

(52) U.S. Cl.
CPC ..... *F41B 5/1453* (2013.01); *F41B 5/105* (2013.01)

(58) Field of Classification Search
CPC ..... F41B 5/1453; F41B 5/105; F41B 5/14; F41B 5/1461
See application file for complete search history.

(56) References Cited

U.S. PATENT DOCUMENTS

| | | | | |
|---|---|---|---|---|
| 5,857,651 | A * | 1/1999 | Kunevicius | F41B 5/14 248/230.8 |
| 9,377,270 | B2 * | 6/2016 | Stokes | F41B 5/1426 |
| 10,801,802 | B2 * | 10/2020 | Long | F41B 5/066 |
| 10,955,214 | B1 * | 3/2021 | Achkar | F41B 5/1426 |
| 2010/0065701 | A1 * | 3/2010 | Fletcher | F41B 5/14 211/85.7 |

* cited by examiner

*Primary Examiner* — Amy J. Sterling
(74) *Attorney, Agent, or Firm* — Bryan J. Massey

(57) ABSTRACT

Disclosed herein is a bow holder retention apparatus. The bow holder retention apparatus includes a body portion having a first retention end and a second retention end positioned in proximity to each other. The bow holder retention apparatus also includes at least one securing element configured to releasably secure the first retention end relative to the second retention end. The bow holder retention apparatus further includes at least one attachment element configured to attach the body portion to a bow. An inner surface of the body portion defines a retention opening configured to removably retain a bow holder when the at least one securing element is releasably securing the first retention end relative to the second retention end.

20 Claims, 13 Drawing Sheets

BOW HOLDER RETENTION APPARATUS AND ASSOCIATED SYSTEMS AND METHODS

CROSS-REFERENCE TO RELATED APPLICATION

This application claims the benefit of U.S. Provisional Patent Application No. 63/535,734, filed Aug. 31, 2023, which is incorporated herein by reference in its entirety.

FIELD

This disclosure relates generally to a device for retaining a bow holder and more particularly to a device for retaining a bow holder to a bow.

BACKGROUND

Hunting with a bow and arrows has significantly increased in popularity in recent years. While hunting, bow hunters often utilize blinds, such as elevated tree stands, that provide an unobstructed field of view while keeping the hunter concealed from game animals. However, waiting for the appearance of game animals can entail prolonged periods of time spent in the tree stand. To avoid constantly holding the bow when it is not in use, many hunters prefer to have a dedicated bow holder. The bow holder can be attached to the tree stand or directly to the tree, securely holding the bow while keeping the bow easily accessible and ready for immediate use. As the bow holder is a distinct device, separate from the bow itself, it is necessary to carry the bow holder in addition to the bow. However, due to its separate nature, the bow holder is at risk of accidental loss or unintentionally forgetting during a hunting trip.

SUMMARY

The subject matter of the present application has been developed in response to the present state of the art, and in particular, in response to the problems of and needs created by, or not yet fully solved by, existing bow holders. Generally, the subject matter of the present application has been developed to provide a bow holder retention apparatus, system, and method that overcome at least some of the above-discussed shortcomings of prior art techniques.

Disclosed herein is a bow holder retention apparatus that includes a body portion having a first retention end and a second retention end positioned in proximity to each other. The bow holder retention apparatus also includes at least one securing element configured to releasably secure the first retention end relative to the second retention end. The bow holder retention apparatus further includes at least one attachment element configured to attach the body portion to a bow. An inner surface of the body portion defines a retention opening configured to removably retain a bow holder when the at least one securing element is releasably securing the first retention end relative to the second retention end. The preceding subject matter of this paragraph characterizes example 1 of the present disclosure.

The at least one securing element is at least one tightening device configured to releasably tighten the first retention end relative to the second retention end. The preceding subject matter of this paragraph characterizes example 2 of the present disclosure, wherein example 2 also includes the subject matter according to example 1, above.

The at least one securing element is at least one magnet configured to releasably attract the first retention end and the second retention end together. The preceding subject matter of this paragraph characterizes example 3 of the present disclosure, wherein example 3 also includes the subject matter according to example 1, above.

The at least one attachment element includes at least one magnet configured to removably attract the body portion to the bow. The preceding subject matter of this paragraph characterizes example 4 of the present disclosure, wherein example 4 also includes the subject matter according to any of examples 1-3, above.

The at least one attachment element includes at least one fastener configured to removably attach the body portion to the bow. The preceding subject matter of this paragraph characterizes example 5 of the present disclosure, wherein example 5 also includes the subject matter according to any of examples 1-3, above.

The retention opening is hollow. The preceding subject matter of this paragraph characterizes example 6 of the present disclosure, wherein example 6 also includes the subject matter according to any of examples 1-5, above.

The retention opening is divided into multiple compartments by at least one sidewall that extends within the retention opening. The preceding subject matter of this paragraph characterizes example 7 of the present disclosure, wherein example 7 also includes the subject matter according to any of examples 1-5, above.

When the at least one securing element is secured, the first retention end and the second retention end are in contact, such that the inner surface is fully enclosed. The preceding subject matter of this paragraph characterizes example 8 of the present disclosure, wherein example 8 also includes the subject matter according to any of examples 1-7, above.

When the at least one securing element is secured, the first retention end and the second retention end are spaced apart from each other, such that the inner surface is partially open. The preceding subject matter of this paragraph characterizes example 9 of the present disclosure, wherein example 9 also includes the subject matter according to any of examples 1-7, above.

The body portion includes a first clamp portion and a second clamp portion, where the first clamp portion is attachable to the second clamp portion. The first clamp portion defines the first retention end and a first attachment end. The second clamp portion defines the second retention end and a second attachment end. The first attachment end is attachable to the second attachment end. The retention opening is defined by an inner surface of the first clamp portion and an inner surface of the second clamp portion. The preceding subject matter of this paragraph characterizes example 10 of the present disclosure, wherein example 10 also includes the subject matter according to any of examples 1-9, above.

Further disclosed herein is a bow holder retention system. The bow holder retention system includes a bow and a bow holder. The bow holder retention system also includes a bow holder retention apparatus. The bow holder retention apparatus includes a body portion having a first retention end and a second retention end positioned in proximity to each other. The bow holder retention apparatus also includes at least one securing element configured to releasably secure the first retention end relative to the second retention end. The bow holder retention apparatus further includes at least one attachment element configured to attach the body portion to a bow. An inner surface of the body portion defines a retention opening configured to removably retain a bow holder when the at least one securing element is releasable securing the first retention end relative to the second retention end. The preceding subject matter of this paragraph characterizes example 11 of the present disclosure.

The bow holder retention system includes a mounting device configured to removably attach to the bow. The bow holder retention apparatus is removably attachable to the mounting device, such that the bow holder retention apparatus is indirectly attachable to the bow via the mounting device. The preceding subject matter of this paragraph characterizes example 12 of the present disclosure, wherein example 12 also includes the subject matter according to example 11, above.

The bow holder retention system includes at least one plate extender defining a first linear length. When the mounting device is attached to the bow that at least one plate extender is positioned between the bow and the mounting device to position the mounting device away from the bow by the first linear length. The preceding subject matter of this paragraph characterizes example 13 of the present disclosure, wherein example 13 also includes the subject matter according to example 12, above.

The mounting device is a plate mount including a plurality of through-holes. The bow includes at least one mount. The bow holder retention apparatus includes at least one attachment aperture. At least one of the plurality of through-holes corresponding with the at least one mount of the bow and at least another one of the plurality of through-holes corresponds with that at least one attachment aperture of the bow holder retention apparatus. The plate mount is removably attached to the bow, via an attachment means, by attaching the at least one of the plurality of through-holes to a corresponding at least one mount. The preceding subject matter of this paragraph characterizes example 14 of the present disclosure, wherein example 14 also includes the subject matter according to example 12, above.

The mounting device is a rod mount including a body portion and a rod-tightening element. The body portion is configured to removably attach to the bow by at least partially encircling the rod of the bow. When the body portion is removably attached to the rod of the bow the rod-tightening element is tightenable to secure the rod mount to the rod. The preceding subject matter of this paragraph characterizes example 15 of the present disclosure, wherein example 15 also includes the subject matter according to example 12, above.

The mounting device is a hole mount includes a body portion having a first segment and a second segment, extending at an angle from the first segment. The first segment includes at least one attachment hole configured to be aligned with, and attachable to a corresponding hole of the bow. The second segment includes at least one through-hole configured to be aligned with, and attachable to a corresponding at least one attachment element. The preceding subject matter of this paragraph characterizes example 16 of the present disclosure, wherein example 16 also includes the subject matter according to example 12, above.

Further disclosed herein is a method of retaining a bow holder to a bow. The method includes removably attaching a bow holder retention apparatus to the bow. The method also includes inserting the bow holder within a retention opening defined by an inner surface of the bow holder retention apparatus. The method further includes removably securing at least one securing element of the bow holder retention apparatus to retain the bow holder within the retention opening. The preceding subject matter of this paragraph characterizes example 17 of the present disclosure.

The method includes removably attaching a mounting device to the bow. The step of removably attaching the bow holder retention apparatus to the bow includes indirectly removably attaching the bow holder retention apparatus to the bow by removably attaching the bow holder retention apparatus to the mounting device. The preceding subject matter of this paragraph characterizes example 18 of the present disclosure, wherein example 18 also includes the subject matter according to example 17, above.

The step of removably securing at least one securing element of the bow holder retention apparatus includes securing at least one tightening device of the bow holder retention apparatus to releasably tighten a first retention end relative to a second retention end of the bow holder retention apparatus. The preceding subject matter of this paragraph characterizes example 19 of the present disclosure, wherein example 19 also includes the subject matter according to any of examples 17-18, above.

The step of removably attaching the bow holder retention apparatus to the bow includes removably attaching the bow holder retention apparatus to at least one mount of the bow. The preceding subject matter of this paragraph characterizes example 20 of the present disclosure, wherein example 20 also includes the subject matter according to any of examples 17-19, above.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter, they are not therefore to be considered to be limiting of its scope. The subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the embodiment is included in at least one example of the present disclosure. Appearances of the phrases "in one example," "in an examples," and similar language throughout this specification may, but do not necessarily, all refer to the same example. Similarly, the use of the term "implementation" means an implementation having a particular feature, structure, or characteristic described in connection with one or more embodiments of the present disclosure, however, absent an express correlation to indicate otherwise, an implementation may be associated with one or more examples.

Disclosed herein are examples of a bow holder retention apparatus and associated system and method. The following provides some features of at least some examples of the bow holder retention apparatus and associated system and method. The bow holder retention apparatus is configured to securely retain (i.e., hold) a bow holder to a bow, when the bow holder is not in use. That is, the bow holder retention apparatus serves as a dedicated holding mechanism for a bow holder, eliminating the need for a bow user to constantly hold or store a bow holder separately from the bow. The bow holder retention apparatus functions by securely retaining the bow holder to the bow, ensuring the bow holder remains easily accessible. By coupling the bow holder to the bow itself, a bow user is relieved from the burden of holding or separately storing a bow holder. Additionally, the bow holder retention apparatus offers versatile attachment options, allowing the bow holder retention apparatus to be utilized with various bow configurations.

Figure 1:
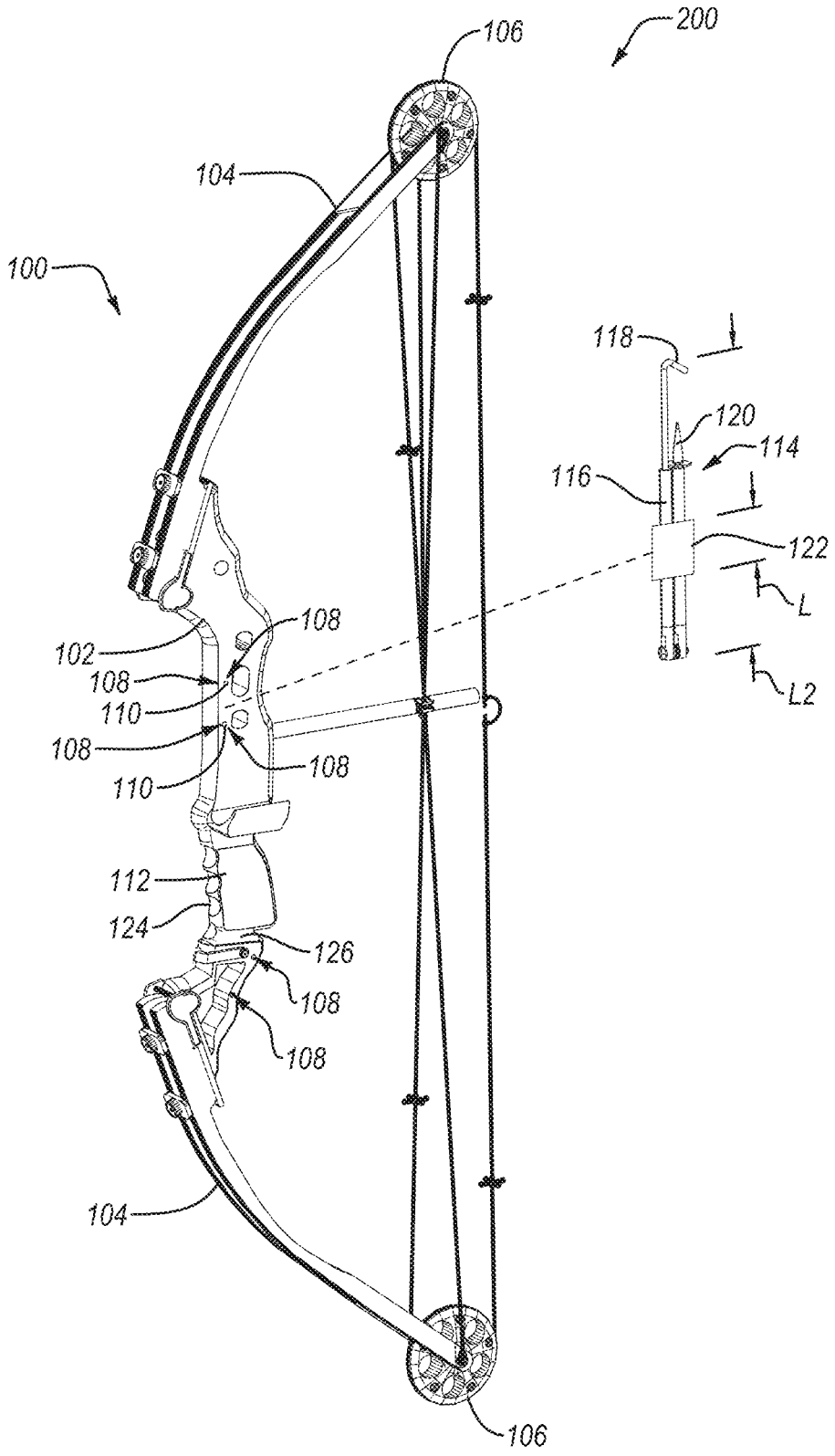
FIG. 1 is a schematic perspective view of a bow holder retention system, with the bow holder retention device separate from the bow, according to one or more examples of the present disclosure.

Referring to FIG. 1, according to one example, a bow holder retention system 200, is shown. A bow 100, of the bow holder retention system 200 is shown in a perspective side view. The bow 100, which may be a compound bow in some examples, includes a riser 102 that serves as the central component of the bow 100. The riser 102 is typically constructed from a lightweight, yet sturdy material, such as aluminum alloy or carbon fiber. Limbs 104, and by extension, pulleys 106, attach to the riser 102. The riser 102 also serves as the mounting point for various accessories such as a sight, an arrow rest, a grip, a stabilizer, a quiver, etc. (see, e.g., FIG. 4). As such, the riser 102 includes at least one attachment point or fixture, referred to herein as a mount 108, which facilitates the attachment of various accessories to the bow 100. The mount 108 may be a sight mount(s) 110 that may be used as the attachment point for a sight (see, e.g., FIG. 4), among other accessories. In some examples, the riser 102 may include multiple sight mounts 110 that are positioned above a grip 112 of the riser 102, allowing for a user to look through the sight while holding the grip 112 of the bow 100, when the sight is attached to the sight mounts 110. The riser 102 may also include other mounts 108, such as mounts 108 in the riser 102 at a location below the grip 112. Additionally, or alternatively, the riser 102 may include a mount 108, other than the sight mounts 110, located in the riser 102 at a location above the grip 112, the mount 108 configured to mount various accessories other than a sight. The mount(s) 108 provides convenience and adaptability to the bow 100, allowing users to customize their bow setup as needed. In yet other examples, a mount 108 may be located on other components of the bow 100, such as the limbs 104, to accommodate additional accessories or configurations.

The mount 108 is configured as the mounting point for an accessory using any of various mounting techniques. In some examples, the mount 108 may have threaded features within the mount 108, allowing an accessory to be fastened to the mount 108 using a screw of a corresponding size within the mount 108. The threading of the mount 108 may be a universal thread size for bow mounts, such as a size commonly used in mounts by those in the art of bow manufacturing. For example, the mount 108 may be sized to fit screws having a size of 10-24. In other examples, the mount 108 may be a hole, without threaded features, thereby allowing accessories to be secured using alternative mechanisms such as bolts or pins.

Also shown in FIG. 1 is a perspective side view of one example of a bow holder 114. The bow holder 114 may be formed generally with an elongated rod 116, a hook member 118, configured to contain the bow 100 on the elongated rod 116, and a coupling member 120, such as a threaded end, configured to be attachable to a tree or tree stand. The elongated rod 116 may have an adjustable length. For example, the elongated rod 116 may include multiple sections that are pivotable, relative to each other, to adjust the length or angle of the elongated rod 116. Alternatively, the elongated rod 116 may have a telescoping elongated rod 116 to increase or decrease the length of the elongated rod 116. In some examples, the bow holder 114 has a single-piece construction. That is, the elongated rod 116, the hook member 118, and the coupling member 120 are fixed together, such that the parts do not detach relative to each other. In other examples, the bow holder 114 has a multi-piece construction. That is, the bow holder 114 is formed by at least two parts that are removably connectable together.

A bow holder retention apparatus 122 is shown retaining the bow holder 114. The bow holder retention apparatus 122 has a length L that is less than a length L2 of the bow holder 114. Accordingly, the bow holder retention apparatus 122 is configured to secure to a portion of the length L2 of the bow holder 114. As used herein, the bow holder retention apparatus 122 is any device that is capable of removable attachment to the bow 100, as well as, capable of securely retaining the bow holder 114 within the bow holder retention apparatus 122. The bow holder retention apparatus 122 is configured to be removably attachable to the bow 100, with or without a bow holder 114 secured within. In one example, the bow holder retention apparatus 122 is removably attachable to the bow 100 by attaching the bow holder retention apparatus 122 to at least one mount 108 of the bow 100.

Figure 2:
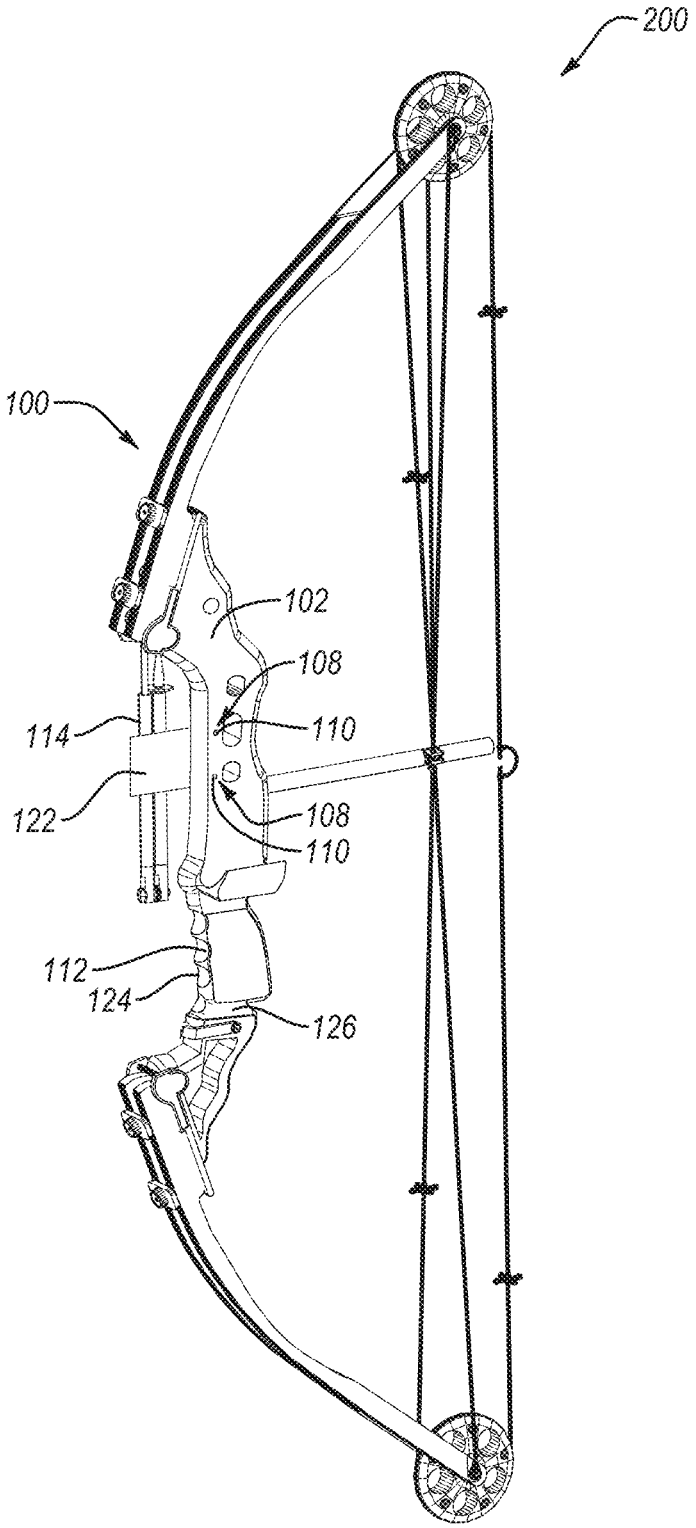
FIG. 2 is a schematic perspective view of the bow holder retention system of FIG. 1, with the bow holder retention device attached to the bow, according to one or more examples of the present disclosure.

Referring to FIG. 2, in one example, the bow holder retention apparatus 122 is removably attached to two sight mounts 110 on the riser 102. In other examples, the bow holder retention apparatus 122 is attachable to a mount 108, other than the two sight mounts 110, of the bow 100. Moreover, the bow holder 114 is securely retained within the bow holder retention apparatus 122, such that the bow holder 114 is removably connected to the bow 100. The ability of the bow holder retention apparatus 122 to attach securely to the mount(s) 108 ensures the safe and reliable retention of the bow holder 114, keeping it firmly in place during transportation and storage of the bow 100.

The bow holder retention apparatus 122 is attached to a first side 124 of the bow 100. The first side 124 is opposite of a second side 126 of the bow 100, the second side 126 designated as the side against an arrow is intended to be placed. In other words, the bow holder retention apparatus 122 is attached to the side opposite to where the arrow is positioned, when the arrow is positioned on the bow 100. Depending on the handedness (e.g., right-handed or left-handed) of the bow 100, the first side 124 can be on the right side or left side of the bow 100. As shown, the bow 100 is a right-handed bow meaning that a user will hold the grip 112 with their left hand and an arrow will be positioned within the bow 100, above the grip 112, on a left side of the riser 102 (i.e., the second side 126). Due to the position of an arrow, some accessories must be added to a right side of the riser 102 (i.e., the first side 124), to avoid obstructing the path of an arrow. Accordingly, the bow holder retention apparatus 122 is removably attached to the right side of the riser 102. However, it should be understood that for a left-handed bow, the bow holder retention apparatus 122 is configured to be securely attached to the left side of the riser 102, as an arrow is configured to be placed on the right side of the riser 102. In other examples, the bow holder retention apparatus 122 may be attached to the second side 126 of the bow 100.

Figure 3:
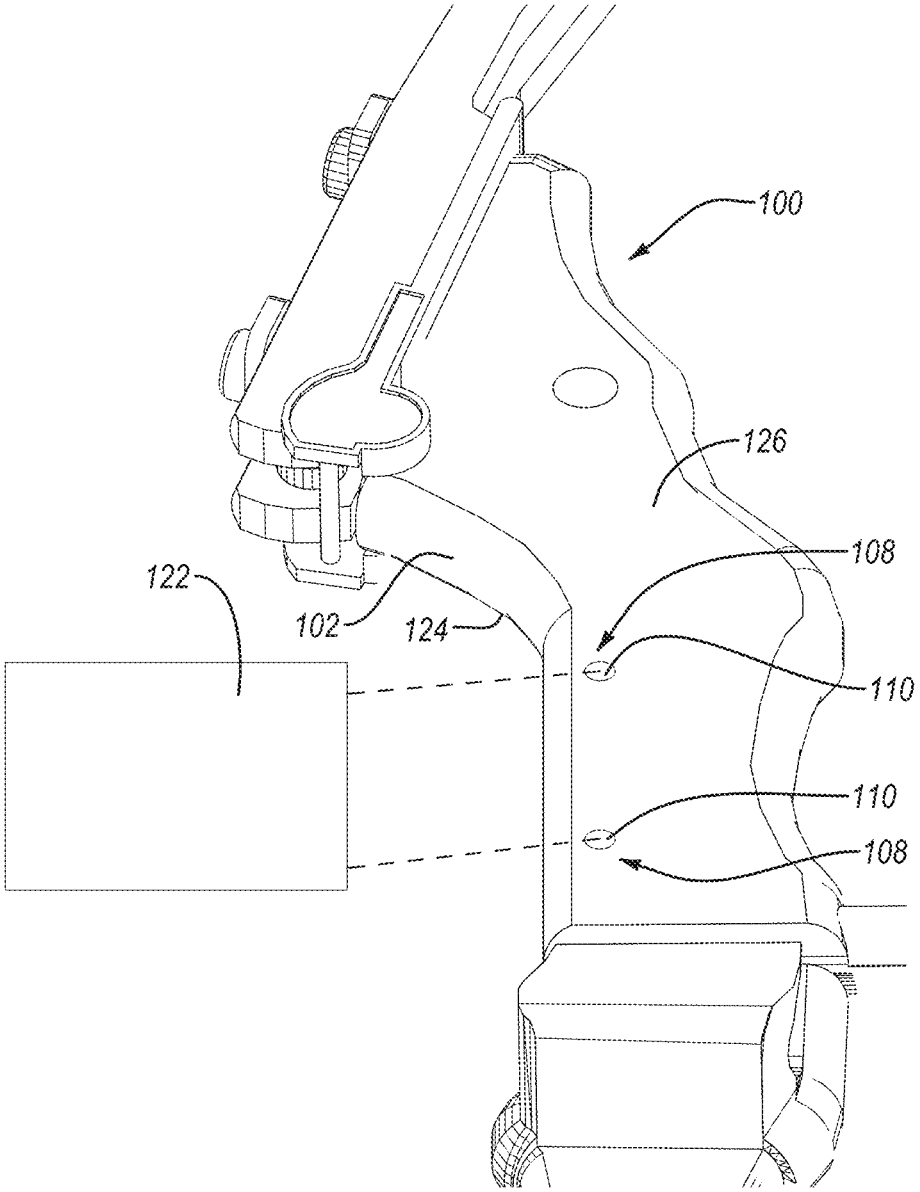
FIG. 3 is a schematic, perspective, partial view of the bow holder retention system of FIG. 1, illustrating mounts on the bow, according to one or more examples of the present disclosure.

An enlarged view of the mounts 108 in the riser 102 are shown in FIG. 3. In some examples, the mounts 108, such as the sight mounts 110, may extend through the riser 102, extending from the first side 124 to the second side 126. In the case of a mount extending through the riser 102, the bow holder retention apparatus 122 may be mountable to either the first side 124 or the second side 126. In other examples, the mounts 108 may only penetrate into the riser 102 from the first side 124 without extending through to the second side 126 of the riser 102. Moreover, the bow holder retention apparatus 122 may be configured to be attachable to a single mount 108, or may be attachable to at least two mounts 108. Accordingly, the bow holder retention apparatus 122 is removably attached to the mount 108, allowing for attachment or detachment of the bow holder retention apparatus 122 from the bow 100. The bow holder retention apparatus 122 may be attached to the bow 100 with or without a bow holder 114 retained within. That is, in some examples, the bow holder retention apparatus 122 is configured to be attached to the bow 100 before the bow holder 114 is placed within the bow holder retention apparatus 122. In other examples, the bow holder retention apparatus 122 can be attached to the bow 100 while the bow holder 114 is retained within. Likewise, the bow holder 114 can, in some examples, be removed from the bow holder retention apparatus 122, while the bow holder retention apparatus 122 remains attached, or partially attached, as in the case of a multi-part bow holder retention apparatus, (see, e.g., FIG. 8), to the bow 100.

Figure 4:
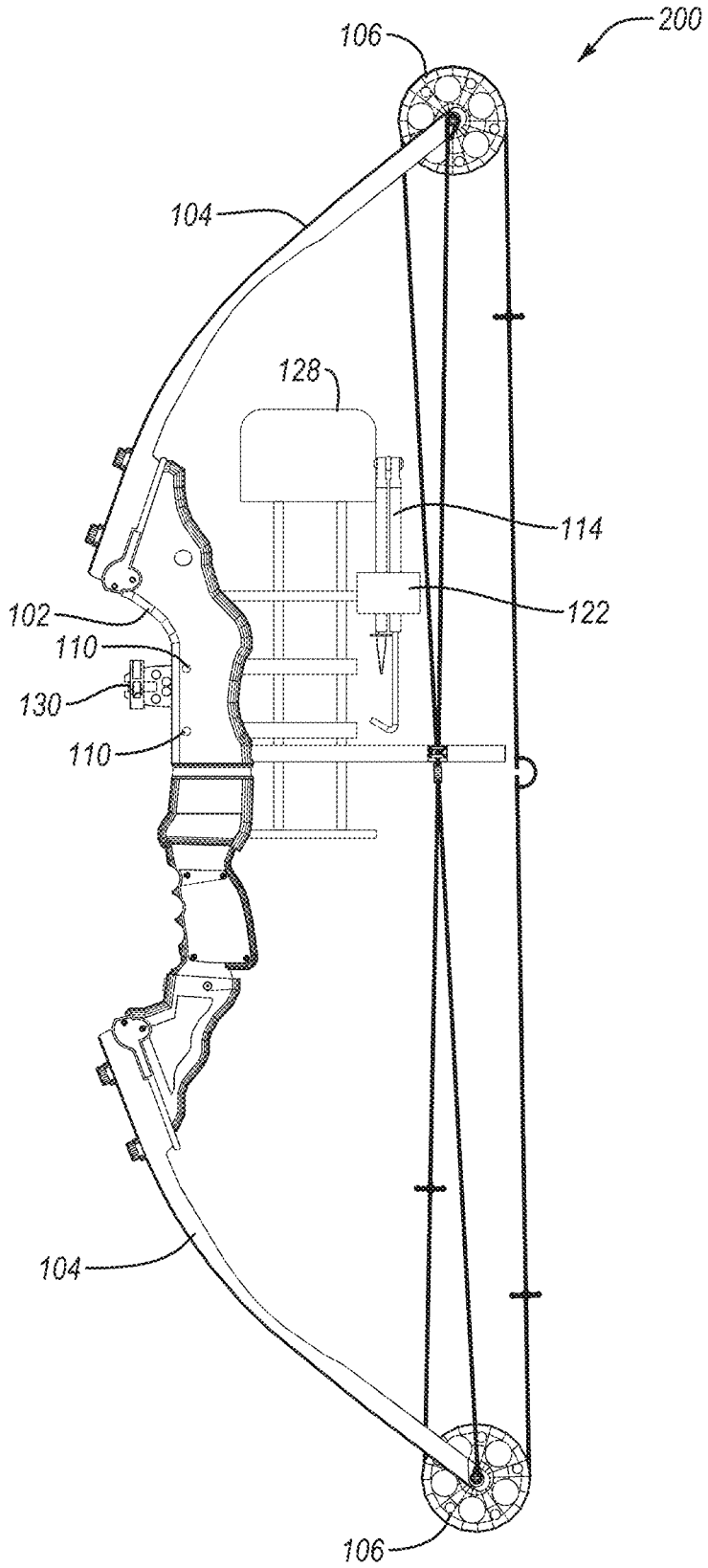
FIG. 4 is a schematic perspective view of a bow holder retention system, with the bow holder retention device attached to a quiver of the bow, according to one or more examples of the present disclosure.

In other examples, the bow holder retention apparatus 122 is configured to be removably attachable to a location, other than the riser 102, on the bow 100. As shown in FIG. 4, the bow holder retention apparatus 122 is removably attached to a quiver 128, which is configured to store arrows for later use with the bow 100. As shown, the quiver 128 is attached to the bow 100 through the sight mounts 110 on the riser 102. A sight 130 is also shown attached to the sight mounts 110, as multiple accessories can be attachable to the sight mounts 110. The bow holder retention apparatus 122 may be configured to be attachable to mounts (not shown) on the quiver 128. Alternatively, the bow holder retention apparatus 122 may be attachable to the quiver 128 through other attachment means, such as straps, hook-and-loop fasteners, magnetic fasteners, etc.

Figure 5:
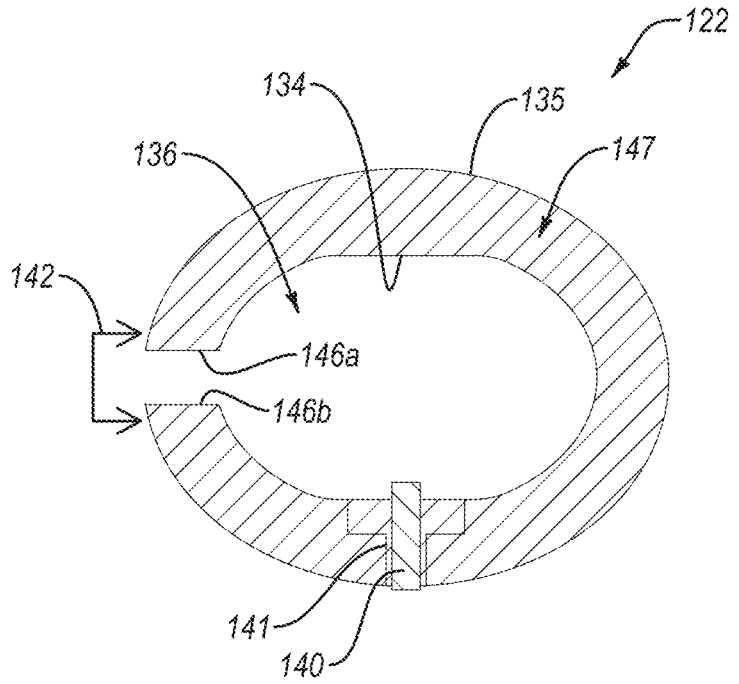
FIG. 5 is a schematic perspective view of an example of a bow holder retention apparatus, according to one or more examples of the present disclosure.
Figure 6:
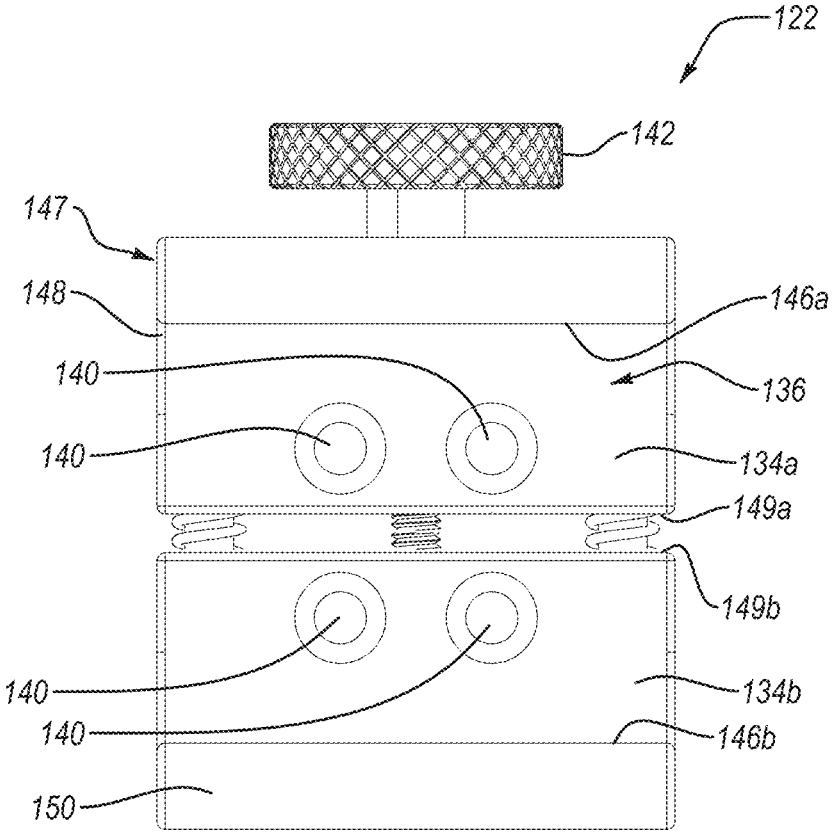
FIG. 6 is a schematic perspective view of another example of a bow holder retention apparatus, according to one or more examples of the present disclosure.
Figure 7:
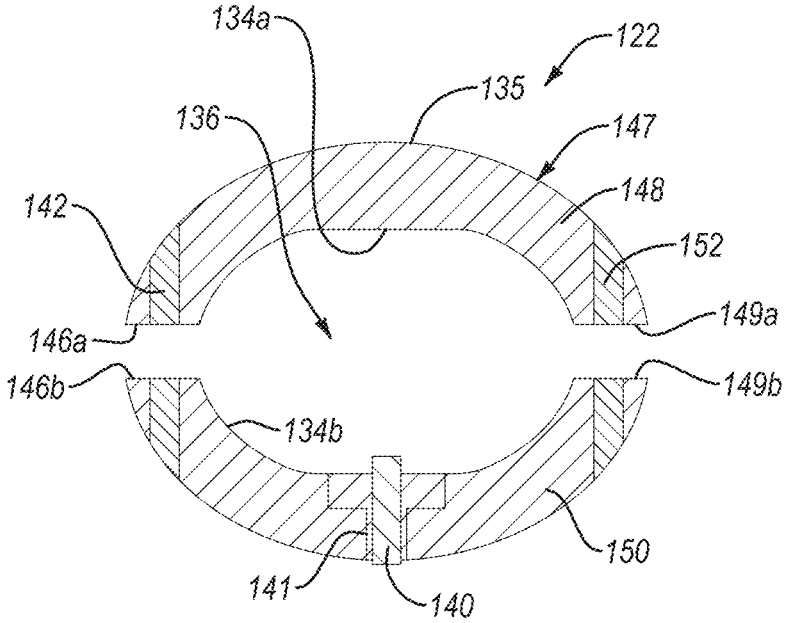
FIG. 7 is a schematic perspective view of another example of a bow holder retention apparatus, according to one or more examples of the present disclosure.

Referring to FIGS. 5-7, some examples of the bow holder retention apparatus 122 are shown. The bow holder retention apparatus 122 is configured to provide retaining support to a bow holder 114 and is configured to be attachable to a bow. The bow holder retention apparatus 122 includes a body portion 147 having an at least partially curved structure. That is, the at least partial curvature of the body portion 147 facilitates secure retention of the bow holder within the bow holder retention apparatus 122. In some examples, the body portion 147 may have a ring-like structure, such as a circular or curved shape, that is configured to surround a retained bow holder. In other examples, the body portion 147 may have a partially-open structure, such that the body portion 147 is not configured to surround the entirety of a retained bow holder. Accordingly, the body portion 147 of the bow holder retention apparatus 122 is not limited to a specific shape, as the body portion 147 can have any of various shapes. The body portion 147 includes a first retention end **146*a* and a second retention end 146*b* positioned in proximity to each other, which enables movement and adjustment relative to one another. As used herein in this context, proximity refers to the spatial relational arrangement of the first retention end 146*a* and the second retention end 146*b***.

An inner surface 134 of the body portion 147 defines a retention opening 136. The retention opening 136 is configured to removably retain a bow holder. That is, a portion of the length L2 of the bow holder 114 is held within the retention opening 136. In some examples, the retention opening 136 is hollow, allowing the bow holder 114 to be held within the hollow retention opening 136. In other examples, the retention opening 136 may be divided into multiple compartments by sidewalls, or otherwise divided compartments, that effectively create separate compartments within the retention opening 136. Each compartment may be configured to retain one part of a multi-part bow holder 114 within separate compartments of the retention opening 136.

The bow holder retention apparatus 122 also includes at least one securing element 142. The at least one securing element 142 is configured to releasably secure the first retention end **146*a* relative to the second retention end 146*b*. That is, the at least one securing element 142 is used to bring the first retention end 146*a* and the second retention end 146*b* closer together (i.e., secure), such that a space between the ends is narrowed by the at least one securing element 142. Accordingly, the at least one securing element 142 is used to removably retain a bow holder when releasably securing the first retention end 146*a* relative to the second retention end 146*b*. The at least one securing element 142 may be any of various mechanisms known for releasably secure two ends together, such as a quick-release fastener, a screw, a clasp, a snap, a hook, or any other suitable securing means. In some examples, the at least one securing element 142 is at least one tightening device configured to releasably tighten the first retention end 146***a* relative to the second retention end 146*b*. For example, the at least one tightening device may be a screw, bolt, clamp, or other fastener. In other examples, the at least one securing element 142 is at least one magnet configured to releasably attract the first retention end 146*a* and the second retention end 146*b* together. The at least one securing element 142 may be used to move one end relative to the other, such as only the first retention end 146*a*, or in other examples, the at least one securing element 142 may be used to move both ends towards each other.

A position of at least one of the first retention end 146*a* or the second retention end 146*b* can be adjusted to expand the size of the retention opening 136, allowing a bow holder to be placed within the retention opening 136. In other words, moving the first retention end 146*a* and the second retention end 146*b* apart, the overall size of the retention opening 136 can be increased. A position of the first retention end 146*a* and the second retention end 146*b* can be adjusted using the at least one securing element 142, or in some examples, due to the flexible nature of the body portion 147 itself. For example, when the at least one securing element 142 is a tightening screw, the tightening screw can be tightened or loosened to adjust the size of the retention opening 136 of the bow holder retention apparatus 122. That is, tightening the screw of the at least one securing element 142 reduces the distance between the first retention end 146*a* and the second retention end 146*b*, thereby decreasing the size of the retention opening 136, while loosening the screw allows for expansion of the retention opening 136. The size of the retention opening 136 may be adjusted to change how tightly a bow holder is retained within the bow holder retention apparatus 122. Additionally, the at least one securing element 142 can be adjusted to change the size of the retention opening 136, such that the bow holder retention apparatus 122 can accommodate different sizes of bow holders.

In some examples, the bow holder retention apparatus 122 has a circumferentially enclosed design. That is, when the at least one securing element 142 is secured, the first retention end 146*a* and the second retention end 146*b* are in contact, such that the inner surface 134 is fully circumferentially enclosed. In other examples, the bow holder retention apparatus 122 has an open design such that it does not entirely surround a bow holder when the bow holder is within the bow holder retention apparatus 122. In other words, when the at least one securing element 142 is secured, the first retention end 146*a* and the second retention end 146*b* are spaced apart from each other, such that the inner surface 134 is partially open.

The bow holder retention apparatus 122 further includes at least one attachment element 140. The at least one attachment element 140 is configured to attach the body portion 147 to a bow. In some examples, the at least one at attachment element 140 is a screw, pin, or other fastener configured to extend through an attachment aperture 141 of the body portion 147 to attach the bow holder retention apparatus 122 to a bow. In other examples, the at least one attachment element 140 is a magnet configured to removably attract the body portion 147 to a bow. In other words, a magnet may be used to directly attract the bow holder retention apparatus 122 to a bow, without the use of a fastener coupling the bow holder retention apparatus 122 to the bow.

The attachment aperture 141 may be configured to correspond with a mount on a bow. That is, the at least one attachment element 140, such as a screw, can extend through the attachment aperture 141 and the corresponding mount to attach the bow holder retention apparatus 122 to a bow. The attachment aperture 141 may be sized to fit an attachment element 140 that is commonly used for accessories that are mounted to bows. For example, the attachment aperture 141 may be sized to fit screws having a size of 10-24. Additionally, the attachment aperture 141 may include threading features, which have the same threading size as a corresponding mount. The attachment aperture 141 may be within the bow holder retention apparatus 122, such that the attachment aperture 141 extends from the inner surface 134 to the outer surface 135 of the bow holder retention apparatus 122. Alternatively, the attachment aperture 141 may be located in an appendage of the bow holder retention apparatus 122, the appendage extending from the outer surface 135 and providing a dedicated space for at least the attachment aperture 141. The appendage may allow for easier access to the attachment aperture 141 and ease of attachment of the bow holder retention apparatus 122 to a bow. Accordingly, the bow holder retention apparatus 122 can be attached to a bow with or without a bow holder retained by the bow holder retention apparatus 122.

In some examples, the bow holder retention apparatus 122 may be made of a resiliently deformable material, such that the flexibility of the resilient material allows the inner surface 134 of the bow holder retention apparatus 122 to undergo partial deformation. The deformation occurs as a result of a bow holder exerting pressure against the inner surface 134 of the bow holder retention apparatus 122. The deformation at various points of the inner surface 134 creates a form-fitting and snug hold for a bow holder, effectively preventing unwanted movement or dislodgment during various activities, including transportation and storage. The resilience of the bow holder retention apparatus 122 ensures that the bow holder retention apparatus 122 maintains its shape and elasticity, allowing for repeat and reliable usage. For example, the resiliently deformable material may be natural or synthetic rubber, thermoplastic elastomer, polyurethane foam, other plastic materials, or other deformable materials. In other examples, the bow holder retention apparatus 122 is made of a nondeformable material, such as a metal, that is configured to hold a bow holder in place without deformation of the bow holder retention apparatus 122.

As shown in FIG. 5, in some examples, the body portion 147 has a ring-like structure, with a generally curved shape (e.g., ring), characterized by a convex outer surface 135 and a concave inner surface 134. In some examples, the body portion 147 has a unitary construction such that the body portion 147 extends in seamless continuity from the first retention end 146*a* to the second retention end 146*b*. The body portion 147 is made of a resiliently deformable material which allows the first retention end 146*a* and the second retention end 146*b* to be moved relative to each other. The at least one securing element 142 is represented as a two-sided arrow connecting the first retention end 146*a* and the second retention end 146*b*, and may be any device that can secure the first retention end 146*a* relative to the second retention end 146*b*. The at least one attachment element 140 is represented as a box extending through the attachment aperture 141, however other attachment elements 140 that do not require the attachment aperture 141 may also be utilized such as a magnet or fastening strip.

Referring to FIG. 6, in some examples, the body portion 147 has a first clamp portion 148 and a second clamp portion 150, which are attached by the at least one securing element 142. The first clamp portion 148 is defined by the first retention end 146*a* and a first attachment end 149*a* and the second clamp portion 150 is defined by the second retention end 146*b* and a second attachment end 149*b*. The first attachment end 149*a* and the second attachment end 149*b* are attached together by the at least one securing element 142. The retention opening 136 is defined by an inner surface 134*a* of the first clamp portion 148 and an inner surface 134*b* of the second clamp portion 150. The retention opening 136 is an open design such that the bow holder retention apparatus 122 does not entirely surround a bow holder, when a bow holder is within the bow holder retention apparatus 122. That is, when the at least one securing element 142 is secured, the first retention end 146*a* and the second retention end 146*b* are spaced apart from each other. The at least one securing element 142 is at least one tightening element that can be manually tightened (e.g., twisted) to bring the first retention end 146*a* closer to the second retention end 146*b* to tighten around a retained bow holder.

Referring to FIG. 7 is another example of a bow holder retention apparatus 122 having a first clamp portion 148 and a second clamp portion 150. The first clamp portion 148 is attached or attachable to the second clamp portion 150 at both ends of the second clamp portion 150. That is, the first retention end 146*a* of the first clamp portion 148 is attachable to the second retention end 146*b* of the second clamp portion 150 by securement of the at least one securing element 142. At the other end of the first clamp portion 148, a first attachment end 149*a* is attachable to the other end of the second clamp portion 150, the second attachment end 149*b*. The first attachment end 149*a* and the second attachment end 149*b* are attachable by a second securing element 152. In one example, the second securing element 152 may permanently fix the first attachment end 149*a* to the second attachment end 149*b*, such as by a hinge or other permanent but movable attachment means. In other examples, the second securing element 152 may removably attach the first attachment end 149*a* to the second attachment end 149*b*, such as by a quick-release fastener, a screw, a clasp, a snap, a hook, or any other suitable fastening means. This removably attachment configuration facilitates easy disassembly and reassembly of the bow holder retention apparatus 122. When the first attachment end 149*a* and the second attachment end 149*b* are attached by the second securing element 152, but the at least one securing element 142 is not secured (i.e., first retention end 146*a* and second retention end 146*b* are not fastened together), the first clamp portion 148 is movable relative to the second clamp portion 150. This allows the first clamp portion 148 to be moved (e.g., opened), relative to the second clamp portion 150, allowing a bow holder to be fitted within the retention opening 136. The first clamp portion 148 can then be secured to the second clamp portion 150 by securing the at least one securing element 142 to securely retain a bow holder within the bow holder retention apparatus 122.

In some examples, the first clamp portion 148 and the second clamp portion 150 are made of the same material. The material may be a resiliently deformable material. Alternatively, the material may be a rigid material that does not deform due to pressure from a retained bow holder. In other examples, the first clamp portion 148 and the second clamp portion 150 may be made of different materials. For example, the first clamp portion 148 may be made of a resiliently deformable material and the second clamp portion 150 may be made of a material that is more rigid (e.g., harder) than the first clamp portion 148. For example, the second clamp portion 150 may be made of a material that is not deformable, such that the second clamp portion 150 does not deform due to pressure from a retained bow holder while the first clamp portion 148 does deform due to pressure from the retained bow holder.

In some examples, the bow holder retention apparatus 122 is configured to be directly attachable to the bow 100. In other examples, the bow holder retention apparatus 122 is indirectly attachable to the bow 100, such that a component (i.e., mounting device) used for attachment is positioned between a bow and the bow holder retention apparatus 122. Accordingly, a mounting device 156 may be used, in some examples, to indirectly mount the bow holder retention apparatus 122 to a bow. That is, the mounting device 156 is attached to the bow 100 and the bow holder retention apparatus 122 is attached to the mounting device 156.

Figure 8:
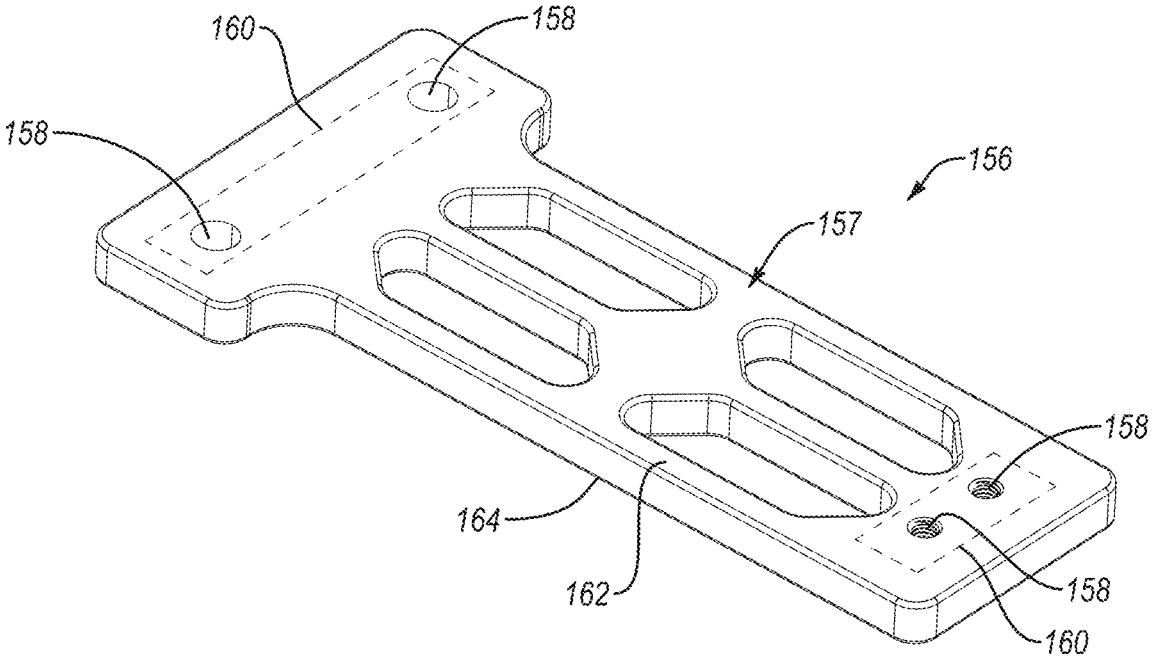
FIG. 8 is a schematic perspective view of an example of a mounting device of the bow holder retention system, according to one or more examples of the present disclosure.
Figure 9:
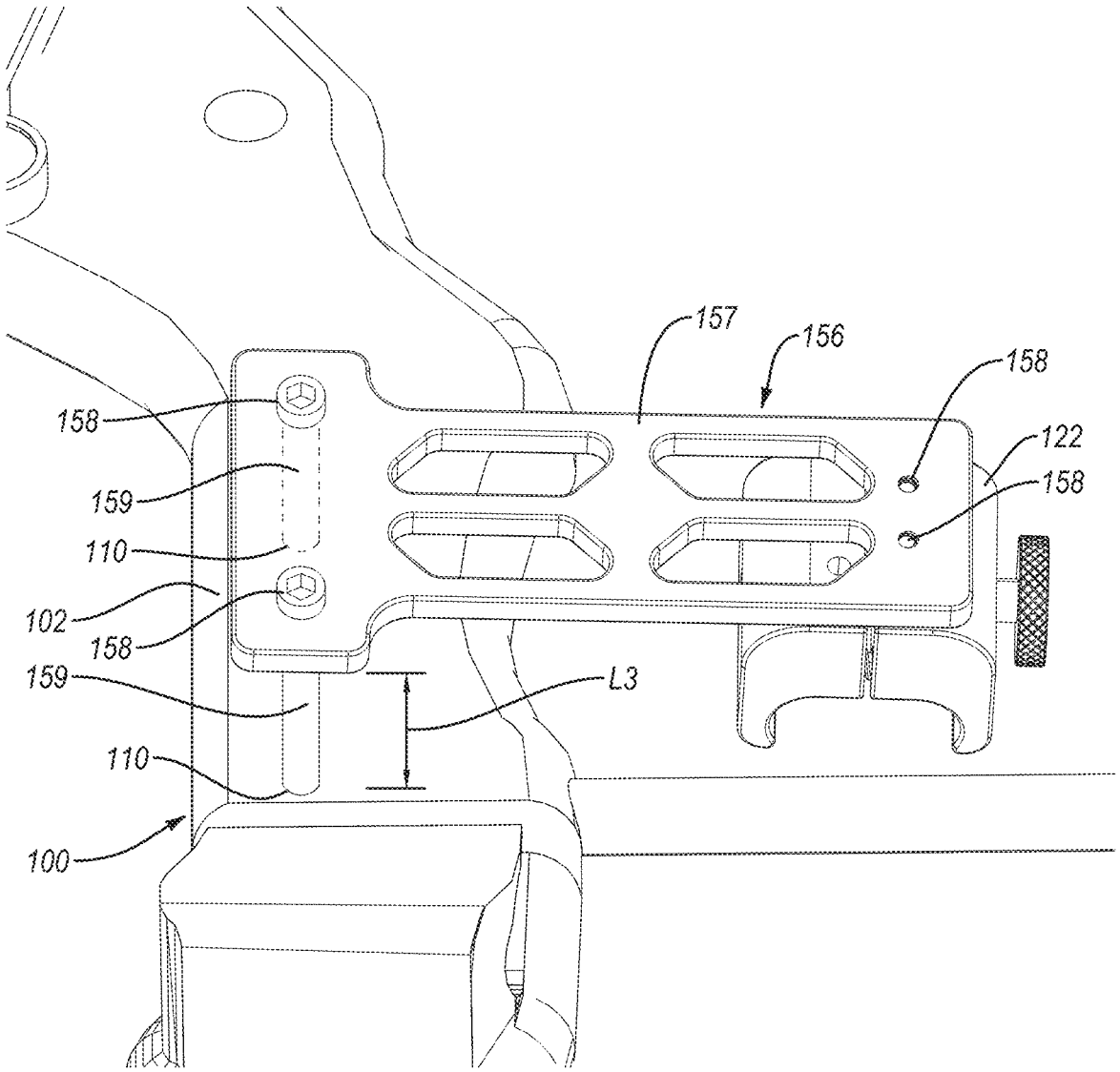
FIG. 9 is a schematic perspective view of the mounting device of FIG. 8 attached to a bow of the bow holder retention system, with the bow holder retention apparatus of FIG. 6, according to one or more examples of the present disclosure.

Referring to FIGS. 8-12, some examples of a mounting device 156 are shown. As shown in FIGS. 8 and 9, the mounting device 156 may be a plate mount 157. The plate mount 157 has at plurality of through-holes 158. At least one of the plurality of through-holes 158 is configured to be alignable with, and attachable to, a mount 108 of the bow 100. Additionally, at least one of the plurality of through-holes 158 is configured to be alignable with, and attachable to, an attachment aperture 141 of the bow holder retention apparatus 122. In some examples, the same through-hole 158 is attachable to both a mount 108 of the bow 100 and the attachment aperture 141 of the bow holder retention apparatus 122. In other examples, one of the plurality of through-holes 158 is attachable to the mount 108 of the bow 100 and another one of the plurality of through-holes 158 is attachable to the attachment aperture 141 of the bow holder retention apparatus 122. The plurality of through-holes 158 may have a uniform size. Alternatively, at least one of the plurality of through-holes may have a different size from at least another one of the plurality of through-holes 158. For example, different sized through-holes 158 may be attached to different mounts 108 of the bow 100 or different sized through-holes 158 may be attached to either a mount 108 of the bow 100 or an attachment aperture 141 of the bow holder retention apparatus 122.

The plate mount 157 is removably attachable to the bow 100. For example, the plate mount 157 may be attached directly a mount, such as to the sight mounts 110 on the riser 102 of the bow 100. That is, at least one through-hole 158 is directly aligned with the mount 108 on the bow and an attachment means is used to removably attach the mounting device 156 to the bow 100. Accessories, such as a sight or a quiver can be added to the bow 100 using the same through-hole(s) 158 as the through-hole attached to the mount 108 or may be attached to the mounting plate using at least another one of the plurality of through-holes 158. Likewise, the bow holder retention apparatus 122 can be removably attached to the plate mount 157 using the same through-hole(s) 158 as the through-hole attached to the mount 108 or may be attached to the plate mount 157 using at least another one of the plurality of through-holes 158. In other examples, a sight, or other accessory may be attached between the bow 100 and the plate mount 157. Generally, the same attachment means, such as a screw, will be used to attach both the plate mount 157 to the sight, and the sight to the bow 100. In other words, the through-hole 158 of the plate mount 157, the mounts on the sight, and the sight mounts 110 are all aligned, such that one attachment means extends through each one to attach both the plate mount 157 and the sight to the bow 100.

In some examples, the plurality of through-holes 158 are arranged into sets of through-holes 160, wherein each set of through-holes 160 is alignable with and attachable to a corresponding set of mounts 108 of the bow 100. For example, the set of through-holes 160 may correspond with two sight mounts 110 of the bow 100. As shown, the plate mount 157 has two sets of through-holes 160, each set of through-holes 160 having two through-holes. However, it is important to note that the plate mount 157 could have more than two sets of through-holes 160. Multiple sets of through-holes 158 allows for flexibility in the attachment of both the plate mount 157 to the bow 100 and the bow holder retention apparatus 122 to the plate mount 157. That is, different sets of through-holes 160 can be used to attach the plate mount 157 to the bow 100 and the bow holder retention apparatus 122 to the plate mount 157. Accordingly, the bow holder retention apparatus 122 can be added to different locations on the plate mount 157 allowing a position of the bow holder retention apparatus 122, relative to the bow 100, to be adjustable. Additionally, in some examples, the bow holder retention apparatus 122 can be removably attachable to either a first side 162 of the plate mount 157, or a second side 164, opposite of the first side 162, of the plate mount 157. This allows for greater flexibility in the position of the bow holder retention apparatus 122, relative to the bow 100.

As shown in FIG. 9, the plate mount 157 is attached to the bow 100, and the bow holder retention apparatus 122 is attached to the plate mount 157. The bow holder retention apparatus 122 is attached to the plate mount 157 at one set of through-holes 158, however, the bow holder retention apparatus 122 could also be attached using only one through-hole 158. The plate mount 157 is attached to the bow 100 at another set of through-holes 158. In some examples, a plate extender 159 or stand-offs may be used between the plate mount 157 and the bow 100 to extend the distance between the plate mount 157 and the bow 100, allowing a greater distance between the plate mount 157 and the bow 100. Specifically, the plate extender 159 defines a first linear length L3, such that the plate extender 159 may be used to extend the distance between the bow 100 and the mounting device 156 by a distance equal to the first linear length L3. As shown, the plate mount 157 is attached to the sight mounts 110 of the bow 100. However, the plate mount 157 and/or plate extender(s) 159 may be attachable to any mounts 108 of the bow 100 or accessories of the bow 100.

Figure 10:
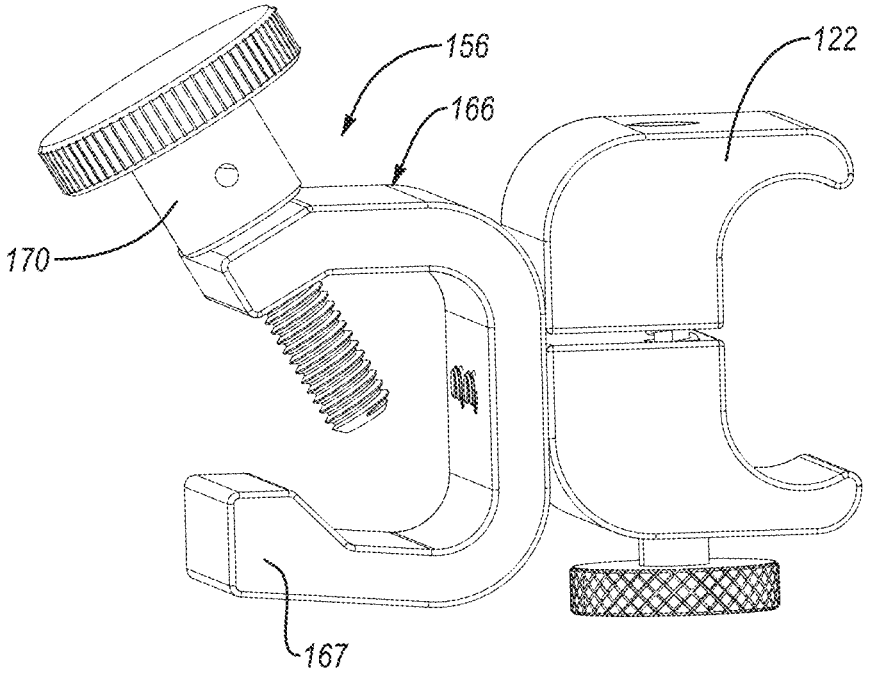
FIG. 10 is a schematic perspective view of another example of a mounting device of the bow holder retention system, with a bow holder retention apparatus of FIG. 6 attached to the mounting device, according to one or more examples of the present disclosure.
Figure 11:
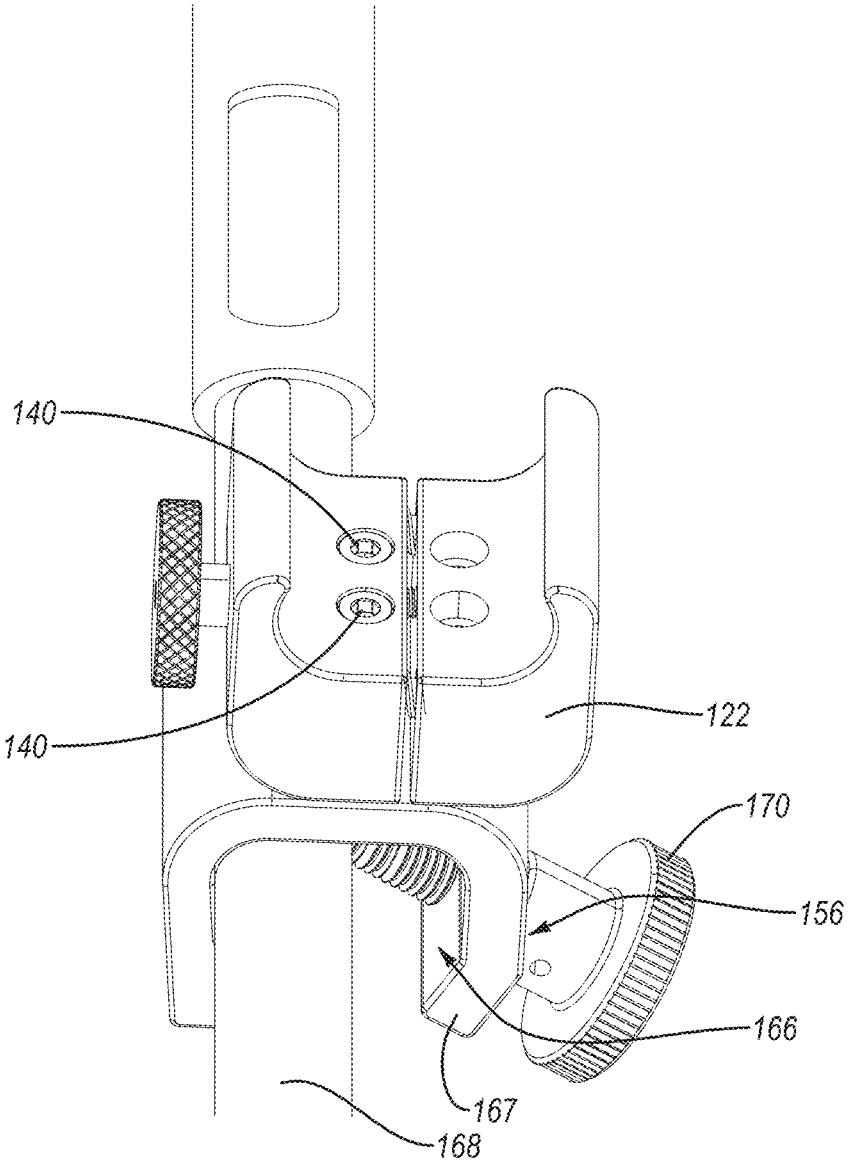
FIG. 11 is a schematic perspective view of the mounting device of FIG. 10 attached to the bow of the bow holder retention system, according to one or more examples of the present disclosure.

Referring to FIGS. 10 and 11, another example of a mounting device 156 is shown. The mounting device 156 may be a rod mount 166. The rod mount 166 is configured to be attachable to any rod 168 of the bow 100. The rod 168 may be a round rod or can be a non-round rod, such as square-shaped rod. As used herein, the rod 168 may refer to any location on the bow 100 or a bow accessory and does not refer to a specific location on the bow 100. For example, the rod 168 may be located on the riser of the bow 100. The rod mount 166, comprising a body portion 167 and a rod-tightening element 170, is attachable to the rod 168 by the rod-tightening element 170, such as a tightening screw, that is configured to be tighten in place against the rod 168. The body portion 167 is configured to removably attach to the bow 100 by at least partially encircling the rod 168 of the bow 100. The bow holder retention apparatus 122 is removably attachable to the rod mount 166 by attaching the at least one attachment element 140 of the bow holder retention apparatus 122 to a through-hole (not shown) of the rod mount 166.

Figure 12:
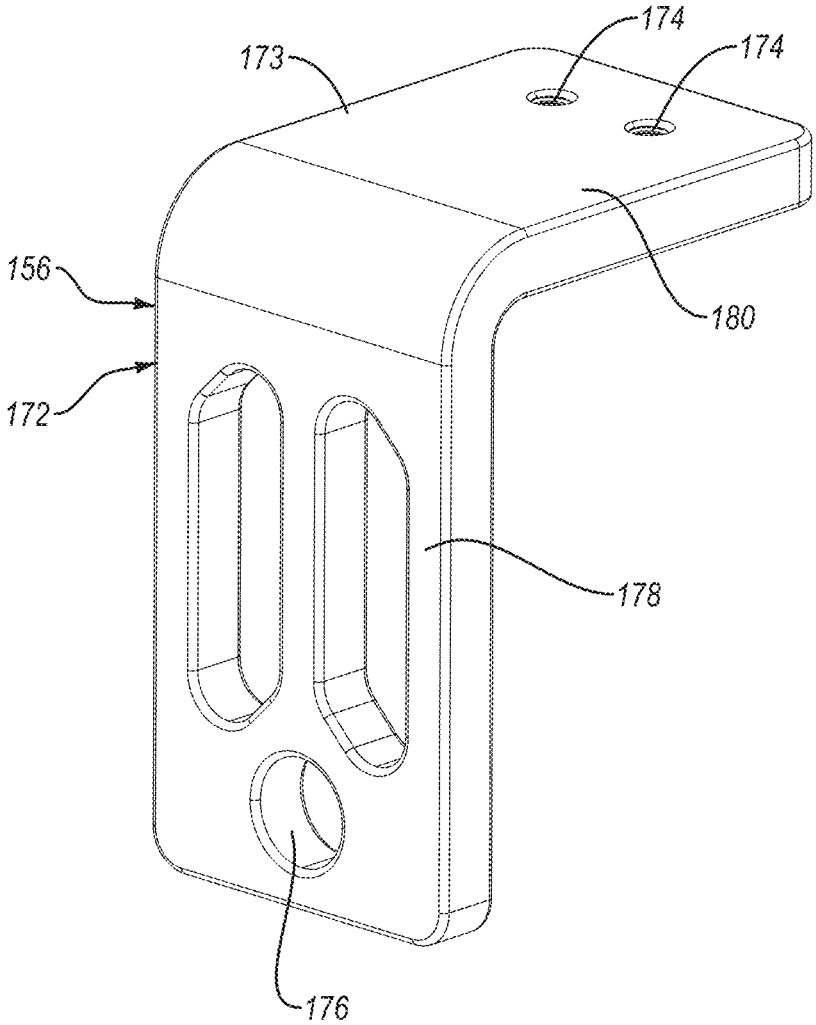
FIG. 12 is a schematic perspective view of another example of a mounting device of the bow holder retention system, according to one or more examples of the present disclosure.

Referring to FIG. 12, another examples of a mounting device 156 is shown. The mounting device, in some examples, may be a hole mount 172. The hole mount 172 is configured to be attachable to any hole of the bow 100 or a bow accessory. The hole mount 172 comprises a body portion 173 that is generally L-shaped. The body portion 173 includes a first segment 178 and a second segment 180, which extends at an angle from the first segment 178. The hole mount 172 includes at least one through-hole 174 in the second segment 180 that is alignable with, and attachable to, the attachment aperture 141 of the bow holder retention apparatus 122. The hole mount 172 also includes at least one attachment hole 176 in the first segment 178 that is aligned with, and attachable to a corresponding hole of the bow 100 or a bow accessory.

Figure 13:
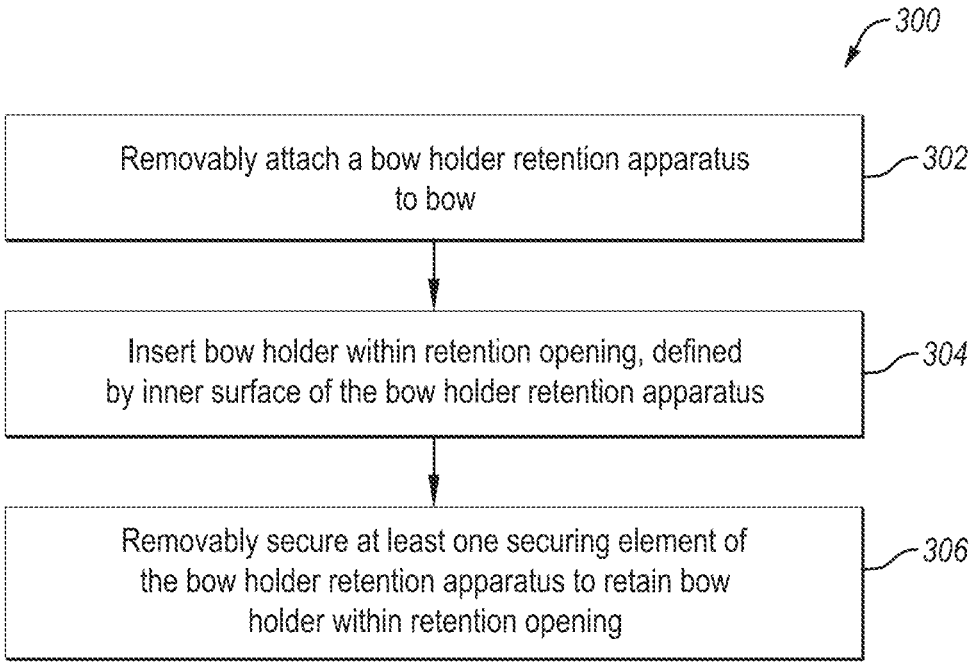
FIG. 13 is a schematic flow diagram of a method of retaining a bow holder to a bow, according to one or more examples of the present disclosure.

Referring to FIG. 13, according to some examples, a method 300 of retaining a bow holder 114 to a bow 100 is shown. The method 300 includes (block 302) removably attaching a bow holder retention apparatus 122 to the bow 100. The bow holder retention apparatus 122 may be removably attached to the bow 100 used any removable attachment element. For example, the bow holder retention apparatus 122 can be attached to the bow using a screw that extends through an attachment aperture 141 on the bow holder retention apparatus 122 and further extends into a mount 108 on the bow 100. In other examples, the bow holder retention apparatus 122 may be removably attachable to a riser 102 of the bow 100 or indirectly to the bow 100 by attaching to a quiver 128 or other accessory attached to the bow 100, by use of straps, hook-and-loop fasteners, magnetic fasteners, etc. The method 300 also includes (block 304) inserting the bow holder 114 within a retention opening 136 defined by an inner surface 134 of the bow holder retention apparatus 122. In some examples, a first retention end **146*a* is movable, relative to a second retention end 146*b* to allow the bow holder 114 to be inserted within the retention opening 136. The method 300 can also be performed with block 304 and block 302 in the reverse order, such that the bow holder 114 is inserted within the retention opening 136 of the bow holder retention apparatus 122 before the bow holder retention apparatus 122 is removably attached to the bow 100. The method 300 further includes (block 306) removably securing at least one securing element 142 of the bow holder retention apparatus 122 to retain the bow holder 114 within the retention opening 136. The at least one securing element 142 is configured to secure the first retention end 146*a* relative to the second retention end 146*b*. That is, the first retention end 146*a* is moved towards the second retention end 146*b*. In some examples, the bow holder 114 is inserted into the retention opening 136 of the bow holder retention apparatus 122 and the at least one securing element 142 is engaged to retained the bow holder 114 within the retention opening 136 before the bow holder retention apparatus 122 is attached to the bow 100**.

In some examples, the bow holder retention apparatus 122 is indirectly attached to the bow 100 using a mounting device 156. That is, the mounting device 156 is attached to the bow 100 and the bow holder retention apparatus 122 is attached to the mounting device 156.

The described features, structures, advantages, and/or characteristics of the subject matter of the present disclosure may be combined in any suitable manner in one or more embodiments and/or implementations. In the above description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the above description and appended claims, or may be learned by the practice of the subject matter as set forth above.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive.

What is claimed is:

1. A bow holder retention apparatus, comprising:

a body portion comprising a first retention end and a second retention end positioned in proximity to each other, the body portion having an inner surface that is at least partially curved and defines a retention opening, and the body portion having at least one attachment aperture extending within the retention opening;

at least one securing element configured to releasably secure the first retention end relative to the second retention end; and at least one attachment element configured to attach the body portion to a bow, wherein the at least one attachment element is receivable within the at least one attachment aperture;

wherein the retention opening is configured to removably retain a bow holder when the at least one securing element is releasably securing the first retention end relative to the second retention end.

2. The bow holder retention apparatus of claim 1, wherein the at least one securing element comprises at least one tightening device configured to releasably tighten the first retention end relative to the second retention end.

3. The bow holder retention apparatus of claim 1, wherein the at least one securing element comprises at least one magnet configured to releasably magnetically attract one of the first retention end or the second retention end to the other of the first retention end or the second retention end.

4. The bow holder retention apparatus of claim 1, wherein the at least one attachment element comprises at least one fastener configured to removably attach the body portion to the bow.

5. The bow holder retention apparatus of claim 1, wherein the retention opening is hollow.

6. The bow holder retention apparatus of claim 1, wherein the retention opening is divided into multiple compartments by at least one sidewall.

7. The bow holder retention apparatus of claim 1, wherein, when the at least one securing element is secured, the first retention end and the second retention end are in contact, such that the inner surface is fully circumferentially enclosed.

8. The bow holder retention apparatus of claim 1, wherein, when the at least one securing element is secured, the first retention end and the second retention end are spaced apart from each other, such that the inner surface is partially open.

9. The bow holder retention apparatus of claim 1, wherein:

the body portion comprises a first clamp portion and a second clamp portion, wherein the first clamp portion is attachable to the second clamp portion;

the first clamp portion defines the first retention end and a first attachment end;

the second clamp portion defines the second retention end and a second attachment end;

the first attachment end is attachable to the second attachment end; and the retention opening is defined by an inner surface of the first clamp portion and an inner surface of the second clamp portion.

10. A bow holder retention system, comprising:

a bow;

a bow holder configured to support the bow, the bow holder being separate and independent from the bow; and a bow holder retention apparatus removably attachable to the bow, the bow holder retention apparatus comprising:

a body portion comprising a first retention end and a second retention end positioned in proximity to each other, the body portion having an inner surface that is at least partially curved and defines a retention opening, the body portion having at least one attachment aperture extending within the retention opening;

at least one securing element configured to releasably secure the first retention end relative to the second retention end; and at least one attachment element configured to removably attach the body portion to the bow, wherein the at least one attachment element is receivable within the at least one attachment aperture;

wherein the retention opening is configured to removably retain the bow holder when the at least one securing element is releasably securing the first retention end relative to the second retention end.

11. The bow holder retention system of claim 10, further comprising a mounting device configured to removably attach to the bow, wherein the bow holder retention apparatus is removably attachable to the mounting device, such that the bow holder retention apparatus is indirectly attachable to the bow via the mounting device.

12. The bow holder retention system of claim 11, further comprising at least one plate extender defining a first linear length, wherein when the mounting device is attached to the bow the at least one plate extender is positioned between the bow and the mounting device to position the mounting device away from the bow by the first linear length.

13. The bow holder retention system of claim 11, wherein:

the mounting device is a plate mount comprising a plurality of through-holes;

the bow comprises at least one mount;

the bow holder retention apparatus comprises at least one attachment aperture;

at least one of the plurality of through-holes of the plate mount corresponds with the at least one mount of the bow and at least another one of the plurality of through-holes of the plate mount corresponds with the at least one attachment aperture of the bow holder retention apparatus; and the plate mount is removably attached to the bow, via an attachment means, by coupling together the at least one of the plurality of through-holes to the at least one mount.

14. The bow holder retention system of claim 11, wherein:

the mounting device is a rod mount comprising a body portion and a rod-tightening element;

the body portion is configured to removably attach to the bow by at least partially encircling the rod of the bow; and when the body portion is removably attached to the rod of the bow the rod-tightening element is tightenable to secure the rod mount to the rod.

15. The bow holder retention system of claim 11, wherein:

the mounting device is a hole mount comprising a body portion, having a first segment and a second segment, extending at an angle from the first segment;

the first segment comprises at least one attachment hole configured to be aligned with, and attachable to a corresponding hole of the bow; and the second segment comprises at least one through-hole configured to be aligned with, and attachable to a corresponding at least one attachment element.

16. The bow holder retention system of claim 10, wherein the at least one securing element comprises at least one tightening device configured to releasably tighten the first retention end relative to the second retention end.

17. The bow holder retention system of claim 10, wherein the at least one attachment element comprises at least one fastener configured to removably attach the body portion to the bow.

18. The bow holder retention system of claim 10, wherein, when the at least one securing element is secured, the first retention end and the second retention end are spaced apart from each other, such that the inner surface is partially open.

19. The bow holder retention system of claim 10, wherein:

the body portion comprises a first clamp portion and a second clamp portion, the first clamp portion being movable relative to the second clamp portion;

the first clamp portion defines the first retention end and a first attachment end;

the second clamp portion defines the second retention end and a second attachment end;

the retention opening is defined by an inner surface of the first clamp portion and an inner surface of the second clamp portion;

the at least one securing element is configured to secure the first attachment end relative to the second attachment end and is adjustable to move the first clamp portion relative to the second clamp portion to change a size of the retention opening; and when the at least one securing element is secured, the first retention end and the second retention end remain spaced apart from each other such that a bow holder is insertable into and removable from the retention opening through a space between the first retention end and the second retention end.

20. The bow holder retention apparatus of claim 9, wherein:

the at least one securing element is adjustable to move the first clamp portion relative to the second clamp portion to change a size of the retention opening; and when the at least one securing element is secured, the first retention end and the second retention end remain spaced apart from each other such that a bow holder is insertable into and removable from the retention opening through a space between the first retention end and the second retention end.

* * * * *